US009783353B2

(12) United States Patent
Kuo et al.

(10) Patent No.: US 9,783,353 B2
(45) Date of Patent: Oct. 10, 2017

(54) SAFE AND ENVIRONMENTAL PROTECTION PACKAGE FOR TINY BATTERY

(71) Applicants: Peng-Yi Kuo, New Taipei (TW); Chung-Chieh Cheng, New Taipei (TW)

(72) Inventors: Peng-Yi Kuo, New Taipei (TW); Chung-Chieh Cheng, New Taipei (TW)

( * ) Notice: Subject to any disclaimer, the term of this patent is extended or adjusted under 35 U.S.C. 154(b) by 233 days.

(21) Appl. No.: 14/730,180

(22) Filed: Jun. 3, 2015

(65) Prior Publication Data

US 2016/0355325 A1 Dec. 8, 2016

(51) Int. Cl.

*B65D 85/00* (2006.01)
*B65D 75/32* (2006.01)
*B65D 73/00* (2006.01)

(52) U.S. Cl.

CPC ..... *B65D 75/322* (2013.01); *B65D 73/0057* (2013.01); *B65D 2209/00* (2013.01); *B65D 2575/329* (2013.01); *B65D 2575/3227* (2013.01); *B65D 2585/88* (2013.01)

(58) Field of Classification Search

CPC ..... B65D 75/22; B65D 75/58; B65D 75/322; B65D 75/321; B65D 75/32; B65D 75/30; B65D 75/28; B65D 75/00; B65D 75/0042; B65D 75/005; B65D 75/0057; B65D 83/0409; B65D 83/02; B65D 83/0454

USPC ..... 206/703, 704, 701; 220/212, 229; 221/82, 66

See application file for complete search history.

(56) References Cited

U.S. PATENT DOCUMENTS 4,015,708 A * 4/1977 Kelm ..... B65D 73/02 206/460
4,384,649 A * 5/1983 Brodsky ..... A61J 1/035 206/532
5,263,577 A * 11/1993 Paratte ..... G04C 10/00 206/38.1
5,839,583 A * 11/1998 Pope ..... B65D 43/162 206/460
6,119,864 A * 9/2000 Kessler ..... B65D 83/04 206/703
7,252,208 B1 * 8/2007 Alvino ..... B65D 83/0463 221/28
9,586,741 B2 * 3/2017 Kuo ..... B65D 75/22
2005/0103680 A1 * 5/2005 Nakatsu ..... B65D 75/327 206/704

(Continued)

*Primary Examiner* — Steven A. Reynolds
*Assistant Examiner* — Javier A Pagan

(57) ABSTRACT

A safe and environmental protection package for tiny battery provides the tiny battery recycled and prevents the children from obtaining and eating by mistake, the technical scheme comprising a bottom cover body and a top cover body; the bottom cover body including a bottom piece body and a containing groove; an exit part disposed in one end of the containing groove and an access groove disposed in the other end thereof; two symmetric low positioning blocks and two symmetric high positioning blocks, by which a containing space is formed with the top cover body; said top cover body including a top piece body, a top groove part, and inserting slit; by applied to the above-mentioned structures, the tiny battery dispose inside the package is removed by inserting the used tiny battery.

8 Claims, 8 Drawing Sheets

(56) References Cited

U.S. PATENT DOCUMENTS

| | | | | |
|---|---|---|---|---|
| 2008/0087571 | A1* | 4/2008 | Sasaki | H01M 2/1044<br>206/703 |
| 2009/0321305 | A1* | 12/2009 | Watson | B65D 43/164<br>206/703 |
| 2012/0080353 | A1* | 4/2012 | Brenner | B65D 75/367<br>206/704 |
| 2013/0161230 | A1* | 6/2013 | Haering | B65D 75/36<br>206/704 |
| 2013/0161231 | A1* | 6/2013 | Haering | B65D 75/367<br>206/704 |

* cited by examiner

SAFE AND ENVIRONMENTAL PROTECTION PACKAGE FOR TINY BATTERY

FIELD OF THE INVENTION

The present invention relates to a safe and environmental protection package, particularly to a safe and environmental protection package for tiny battery.

BACKGROUND OF THE INVENTION

At present, a safe package for tiny battery is used as a structure to prevent the children from easily opened, however, it is only for whole new package without being opened, but the children are still likely to get the used battery and swallow by mistake if the battery is not properly processed or recycled.

In view of this problem, the prior art need to be further improved.

SUMMARY OF INVENTION

The purpose of the invention is to provide a safe and environmental protection package for tiny battery (200), comprising: said safe and environmental protection package (100) including a bottom cover body (1) and a top cover body (2); the bottom over body (1) including a bottom piece body (11); a containing groove (12) disposed inside the bottom piece body (11); an exit part (121) disposed in one end of the containing groove (12) and formed an outward tilt therefrom; an access groove (122) disposed in the other end of the containing groove (12), the width of which is longer than the one of the containing groove (12); two symmetric low positioning blocks (123) and two symmetric high positioning blocks (124) are respectively disposed in both side walls of the containing groove (12) between the exit part (121) and the access groove (122); and a containing space (10) formed by the two low positioning blocks (123), two high positioning blocks (124), and the top cover body (2) to receive the tiny battery (200); said top cover body (2) including a top piece body (21) corresponding to the bottom piece body (11); a to groove part (22) disposed inside the top piece body (21), said top groove part (22) corresponding to the access groove (122), and covered up the access part (122) and the two positioning blocks (124); a ⊓-shaped inserting slit (221), the center of which is disposed in the access part (122), and an opening of which is directly faced to the exit part (121), wherein the inserting slit (221) is configured to have the tiny battery (200) inserted therein to push the other tiny battery (200) disposed inside the containing space (10); the bottom piece body (11) of the bottom cover body (1) being tightly coupled with the top piece body (21) of the top cover body (2), in which an exit slit (3) is formed therebetween near the exit part (121); an upper part and an lower part of the exit slit (3) being coupled with each other.

More preferably, wherein the bottom cover body (1) and the top cover body (2) are the same size, and preferably formed in rectangular shape. More preferably wherein the safe and environmental protection package (100) is made of one of following high polymer materials: PET, PP, PE, PVC. More preferably, wherein the too groove part (22) includes an arc part (222) correspondingly disposed in one side of the tiny battery (200) within the containing space (10).

More preferably, wherein the containing groove (12) is at least two times deeper than the top groove part (22).

More preferably, wherein the entrance slit (221) is wider than or equal to the containing groove (12).

More preferably, wherein the upper and the lower part of the exit slit (3) are coupled each other, which is formed by one of the following methods: an ultrasonic welding process, a glue joint process, or a clipper joint. More preferably, wherein the exit slit (3) is configured in one of the following: a joint configuration or an opening slit configuration. Compared to prior art, the utility model has the main advantage that:

1. By applied to the structures of the containing groove (12), the top groove part (22), the access groove (122), and the inserting slit (221), the tiny battery (200) should be removed by inserting the used tiny battery (200*b*), so the used tiny battery (200*b*) can be recycled effectively avoided obtained and eating by mistake for the children.
2. The bottom cover body (1) and the op cover body (2) are simple structures and the technology is not too high, so it is easy to produce and sale in the market.

DETAILED DESCRIPTION OF THE PREFERRED EMBODIMENTS

Figure 1:
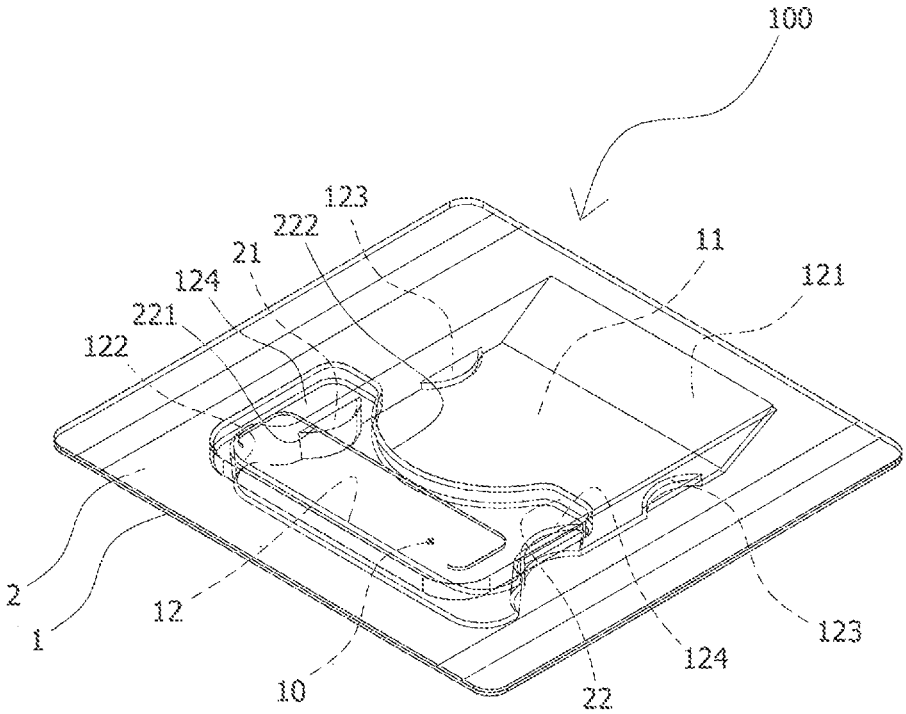
FIG. 1 is a perspective, schematic view of a safe and environmental protection package for tiny battery of the present invention.
Figure 2:
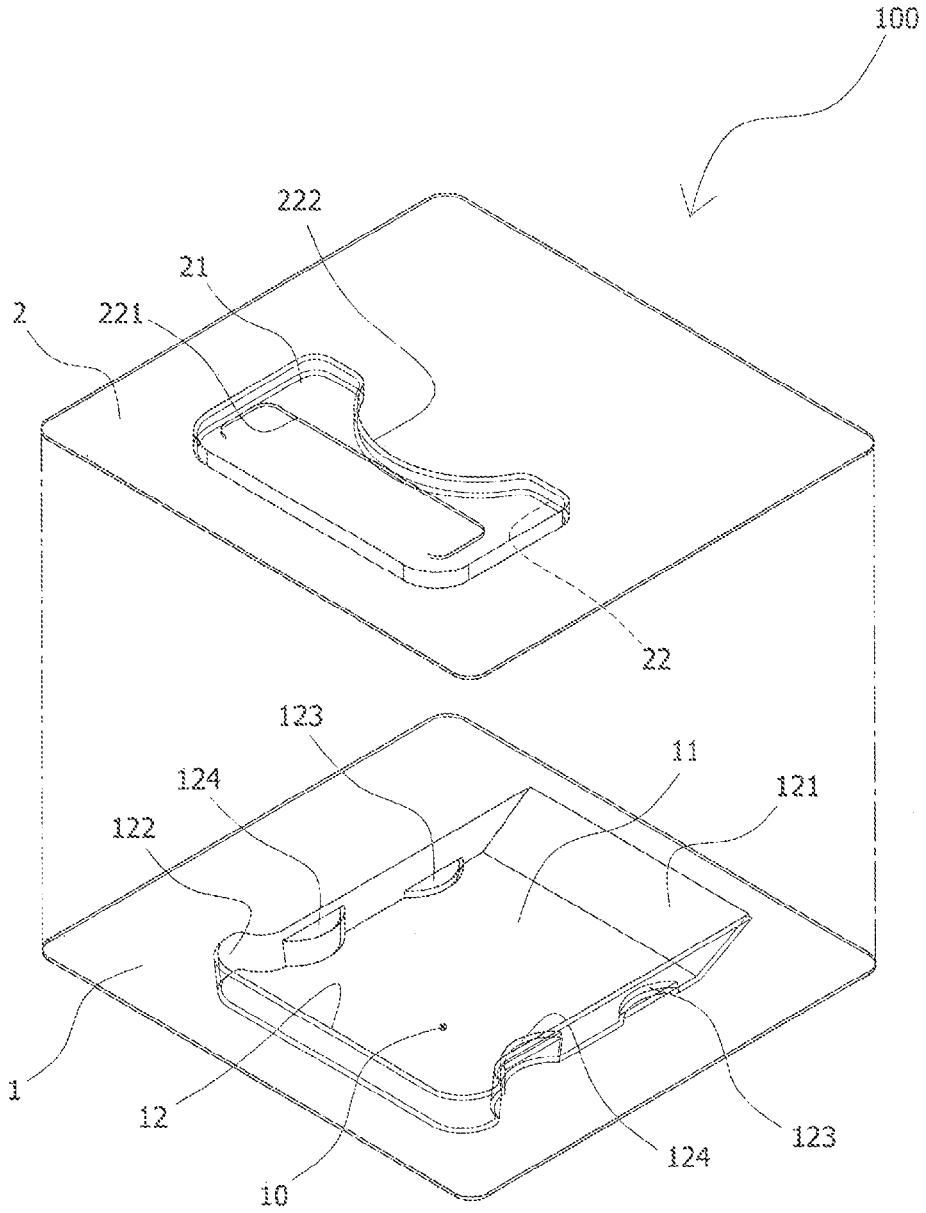
FIG. 2 is an exploded view thereof.

Refer to FIG. 1 to FIG. 7, the Figures disclose a safe and environmental protection package for tiny battery (200), comprising: said safe and environmental protection package (100) including a bottom cover body (1) and a top cover body (2); the bottom cover body (1) including a bottom piece body (11); a containing groove (12) disposed inside the bottom piece body (11); an exit part (121) disposed in one end of the containing groove (12) and formed an outward tilt therefrom; an access groove (122) disposed in the other end of the containing groove (12), the width of which is longer than the one of the containing groove (12); two symmetric low positioning blocks (123) and two symmetric high positioning blocks (124) are respectively disposed in both side walls of the containing groove (12) between the exit part (121) and the access groove (122); and a containing space (10) formed by the two low positioning blocks (123), two high positioning blocks (124), and the top cover body (2) to receive the tiny battery (200); said top cover body (2) including a top piece body (21) corresponding to the bottom piece body (11); a top groove part (22) disposed inside the to piece body (21), said top groove part (22) corresponding to the access groove (122), and covered up the access part (122) and the two positioning blocks (124); a ⊓-shaped inserting slit (221), the center of which is disposed in the access part (122), and an opening of which is directly faced to the exit part (121), wherein the inserting slit (221) is configured to have the tiny battery (200) inserted therein to push the other tiny battery (200) disposed inside the containing space (10); the bottom piece body (11) of the bottom cover body (1) being tightly coupled with the top piece body (21) of the top cover body (2), in which an exit slit (3) is formed therebetween near the exit part (121); an upper part and an lower part of the exit slit (3) being coupled with each other.

Concerning the tiny battery (200), the following descriptions will be divided into an unused tiny battery (200*a*) and a used tiny battery (200*b*), if not specified, it is the tiny battery (200).

By the above mentioned structure, the unused tiny battery (200*a*) can be easily removed by inserting with two hands into the used tiny battery (200*b*), so as to pretend the used tiny battery (200*b*) and the new tiny battery (200*a*) obtaining erroneously from the children; besides, the used tiny battery (200*b*) also can be compulsively recycled.

Figure 7:
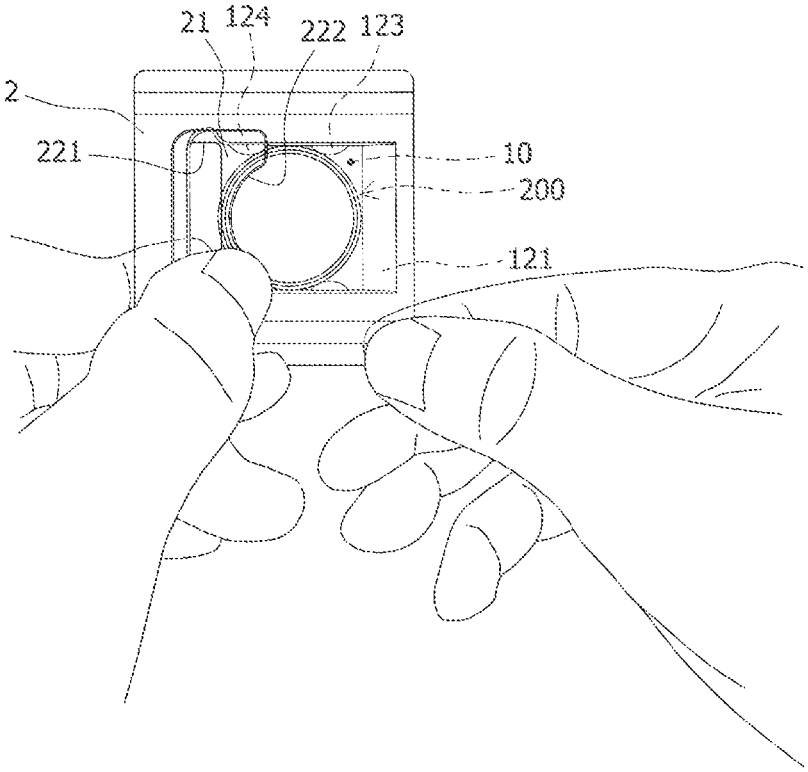
FIG. 7 is a schematic view showing safety effectiveness of the present invention.
Figure 7:
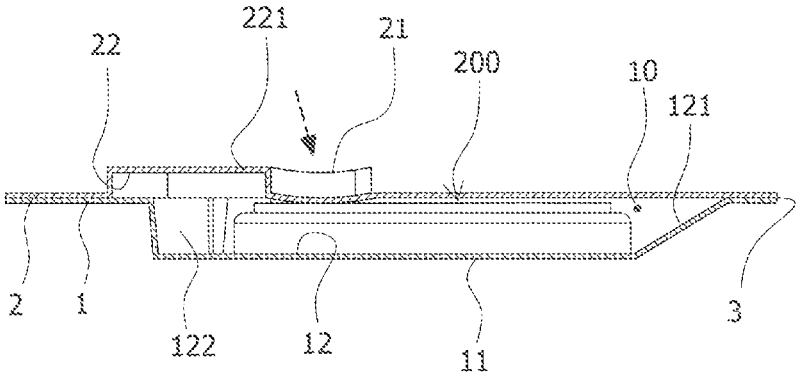
Figure 8:
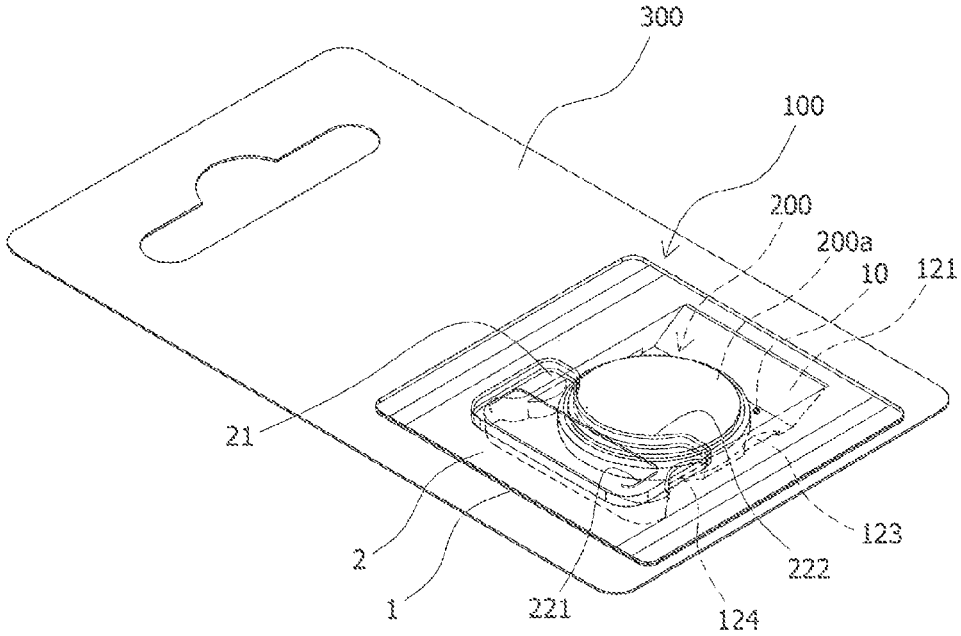
FIG. 8 is a schematic view of the present invention applied with a hangtag.

Secondly, the structure of the top groove part (22) is hard enough to resist the pressure to prevent squeezing out from the containing groove (12) as shown in FIG. 7, and the tiny battery (200) is also not fell out of the containing groove (12), so the only one way is to insert the used tiny battery (200*b*) into the inserting slit (221) to remove the unused tiny battery (200*a*).

Figure 3:
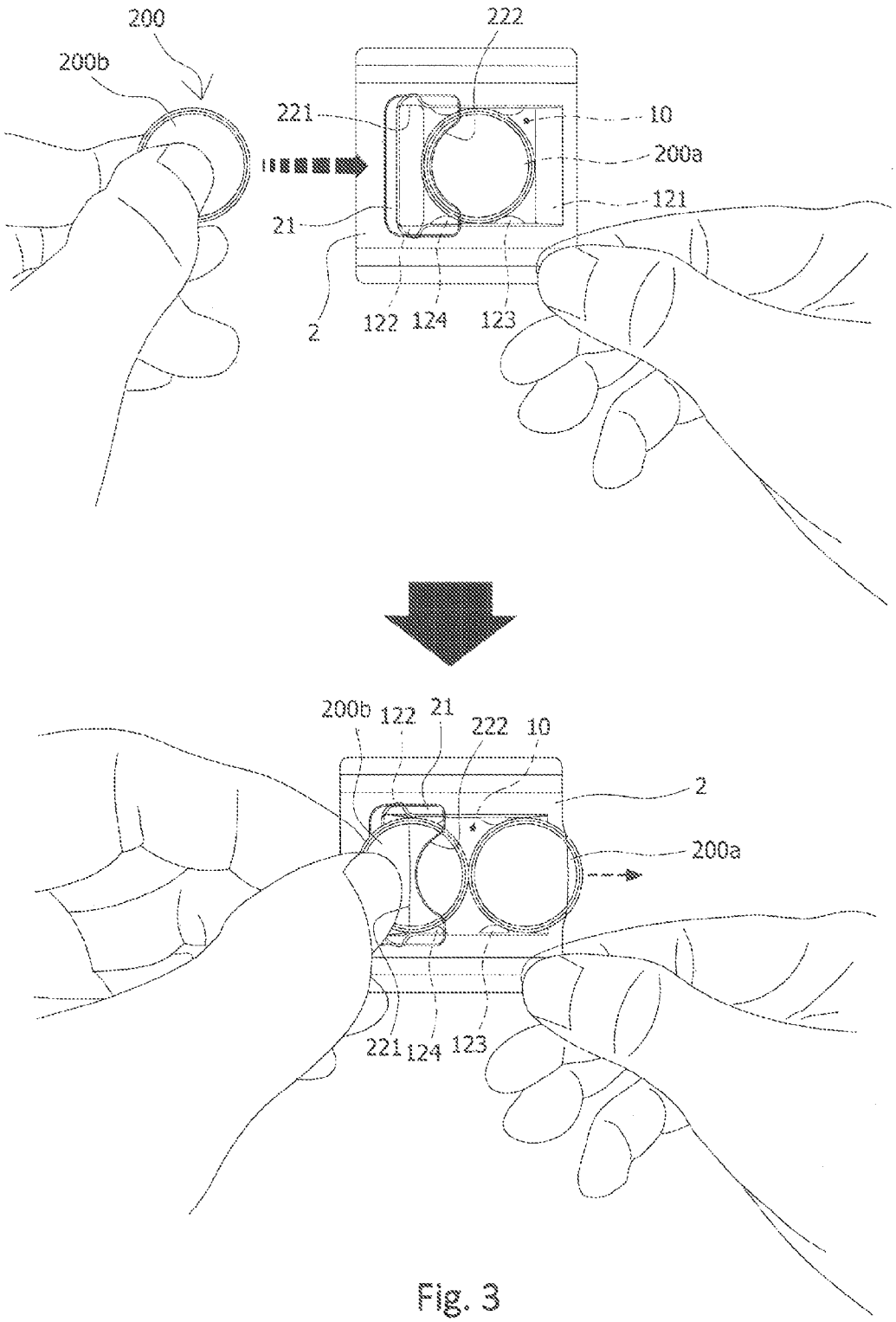
FIG. 3 and FIG. 4 are implementation views thereof.
Figure 4:
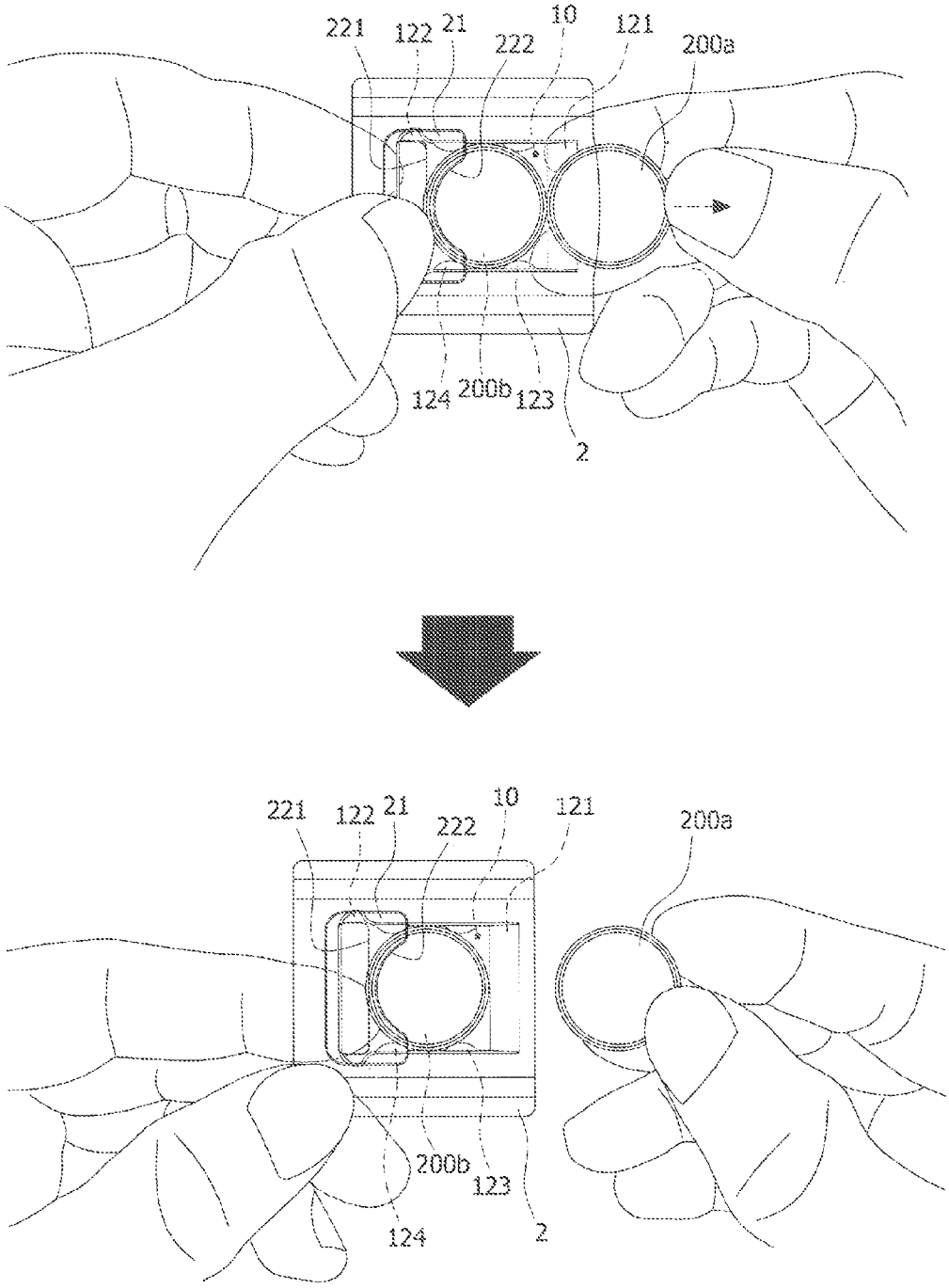
Figure 5:
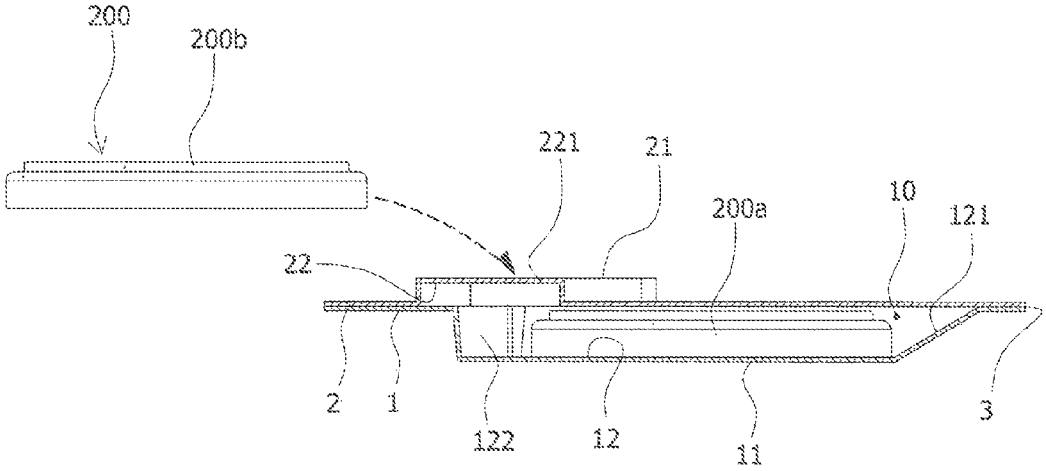
FIG. 5 and FIG. 6 are implementation sectional views thereof.
Figure 5:
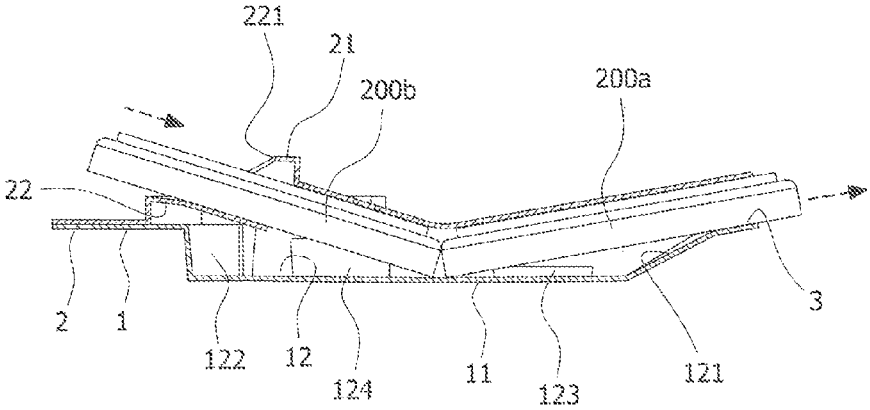
Figure 6:
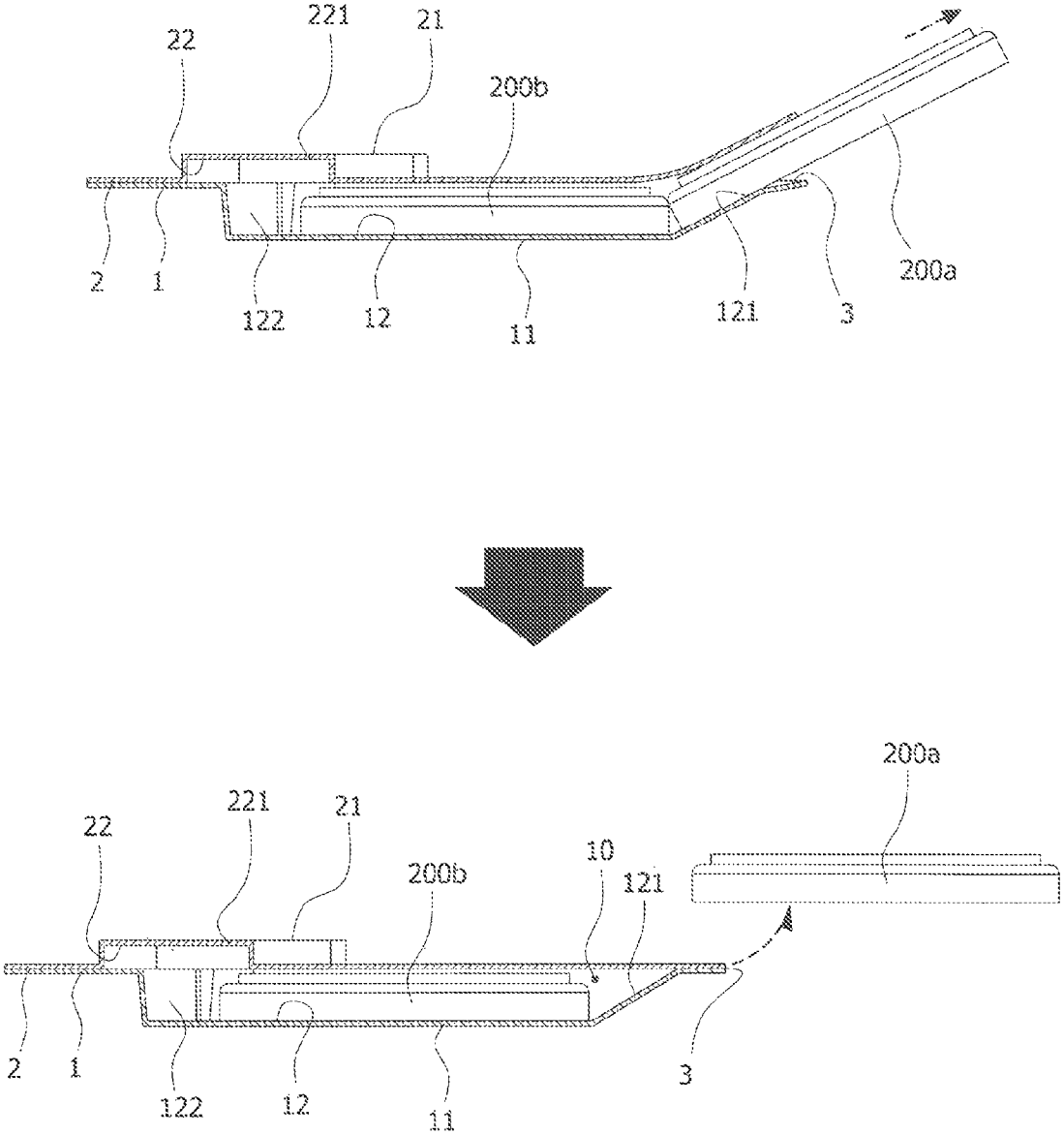

Refer to FIG. 3 to FIG. 5, the Safe and environmental protection package (100) of the present invention is used in following steps:

1. Hold the bottom cover body (1) and the top cover body (2) from away one side of the inserting slit (221) with one hand.
2. Hold one end of used tiny battery (200*b*) with the other hand to insert into the inserting slit (221) to move the inserting slit (221) down to the access groove (122) for facilitating the used tiny battery (200*b*) entry the smoothly, and then continuously push the used tiny battery (200*b*) to the containing space (10) to push the unused tiny battery (200*a*) to the exit part (121), until the unused tiny battery (200*a*) moves out of the exit slit (3), whereby the used tiny battery (200*b*) can be recycled.

The safe and environmental protection package (100) cannot will not be easily damaged except by the above mentioned method or cutting, so the package can prevent the children from obtaining and eating by mistake.

Wherein the bottom cover body (1) and the top cover body (2) are the same size, and preferably formed in rectangular shape, whereby the structure can save producing materials and assemble easily. Besides, the rectangular structure can be hold easily when replacing the tiny battery (200).

Wherein the safe and environmental protection package (100) is made of one of following high polymer materials: PET, PP, PE, PVC, by which the safe and environmental protection package (100) is easy to produce and to identify the tiny battery therein, in addition, the package structure is hard enough to prevent the children from obtained.

Wherein the top groove part (22) includes an are part (222) correspondingly disposed in one side of the tiny battery (200) within the containing space (10). The art part (222) intensifies the structure of the top groove part (22) and fix the tiny battery (200).

Wherein the containing groove (12) is at least two times deeper than the top groove part (22); the containing groove is configured to receive the tiny battery (200), and the top groove part (22) is configured to prevent the tiny battery from squeezing out therefore the containing groove (12) need to be deeper than the top groove part (22); in addition, the structure of the top groove part (22) and the containing groove (12) can ensure that the used tiny battery (200*b*) inserts smoothly and pushes the unused tiny battery (200*a*) disposed inside the containing space (10), until the used tiny battery (200*b*) replaces the unused tiny battery (200*a*) position.

Wherein the entrance slit (221) is wider than or equal to the containing groove (12); the entrance slit (221) is configured to have the tiny battery (200) inserted therein, therefore the wide entrance of the entrance slit (221) can make the tiny battery (200) easily inserted.

Wherein the upper and the lower part of the exit slit (3) are coupled each other, which is formed by one of the following methods: an ultrasonic welding process, a glue joint process, or a clipper joint. Different formation of the exit slit (3) can be made to meet customer demand.

Wherein the exit slit (3) is configured in one of the following: a joint configuration or an opening slit configuration. Different formation of the exit slit (3) can be made to meet customer demand.

The safe and environmental protection package (100) applies with a hangtag (300) to hang in the shelf to display for customer.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the or description, and all changes which come within the meaning and range of equivalency of the claims are therefore intended to be embraced therein.

We claim:

1. A safe and environmental protection package for a tiny battery (200), comprising:

said safe and environmental protection package (100) including a bottom cover body (1) and a top cover body (2);

the bottom cover body (1) including a bottom piece body (11); a containing groove (12) disposed inside the bottom piece body (11); an exit part (121) disposed in one end of the containing groove (12) and forming an outward tilt therefrom; an access groove (122) disposed in the other end of the containing groove (12), the width of which is longer than the one of the containing groove (12); two symmetric low positioning blocks (123) and two symmetric high positioning blocks (124) are respectively disposed in both side walls of the containing groove (12) between the exit part (121) and the access groove (122); and a containing space (10) formed by the two low positioning blocks (123), two high positioning blocks (124), and the top cover body (2) to receive the tiny battery (200);

said top cover body (2) including a top piece body (21) corresponding to the bottom piece body (11); a top groove part (22) disposed inside the top piece body (21), said top groove part (22) corresponding to the access groove (122), and covering up the access part (122) and the two positioning blocks (124); a ⊓-shaped inserting slit (221), the center of which is disposed in the access part (122), and an opening of which is directly faced to the exit part (121), wherein the inserting slit (221) is configured to have the tiny battery (200) inserted therein to push the other tiny battery (200) disposed inside the containing space (10);

the bottom piece body (11) of the bottom cover body (1) being tightly coupled with the top piece body (21) of the top cover body (2), in which an exit slit (3) is formed therebetween near the exit part (121); an upper part and a lower part of the exit slit (3) being coupled with each other.

2. The safe and environmental protection package for tiny battery according to claim 1, wherein the bottom cover body (1) and the top cover body (2) are the same size, and preferably formed in a rectangular shape.

3. The safe and environmental protection package for tiny battery according to claim 2, wherein the safe and environmental protection package (100) is made of one of following high polymer materials: PET, PP, PE, PVC.

4. The safe and environmental protection package for tiny battery according to claim 3, wherein the top groove part (22) includes an arc part (222) correspondingly disposed in one side of the tiny battery (200) within the containing space (10).

5. The safe and environmental protection package for tiny battery according to claim 4, wherein the containing groove (12) is at least two times deeper than the top groove part (22).

6. The safe and environmental protection package for tiny battery according to claim 5, wherein the entrance slit (221) is wider than or equal to the containing groove (12).

7. The safe and environmental protection package for tiny battery according to claim 6, wherein the upper and lower part of the exit slit (3) are coupled to each other, which is formed by one of the following methods: an ultrasonic welding process, a glue joint process, or a clipper joint.

8. The safe and environmental protection package for tiny battery according to claim 7, wherein the exit slit (3) is configured in one of the following: a joint configuration or an opening slit configuration.

* * * * *